United States Patent [19]

Barbagli

[11] Patent Number: 4,461,320

[45] Date of Patent: Jul. 24, 1984

[54] MANUALLY OPERABLE HYDRAULIC CONTROL DEVICE WITH HYDRAULIC POSITION RETENTION

[75] Inventor: Rino O. Barbagli, Borgaretto, Italy

[73] Assignee: Fiat Allis Europe S.p.A., Lecce, Italy

[21] Appl. No.: 371,551

[22] Filed: Apr. 26, 1982

[30] Foreign Application Priority Data

Jul. 9, 1981 [IT] Italy ..... 67956 A/81

[51] Int. Cl.[3] ..... F15B 13/042

[52] U.S. Cl. ..... 137/625.6; 91/426; 137/596.1; 137/636.2

[58] Field of Search ..... 91/426; 137/596, 596.1, 137/596.14, 625.6, 636.1, 636.2, 868

[56] References Cited

U.S. PATENT DOCUMENTS

| | | | |
|---|---|---|---|
| 2,958,233 | 11/1960 | Johnson | 137/636.2 X |
| 3,301,136 | 1/1967 | Bolton et al. | 91/426 X |
| 3,605,814 | 9/1971 | Gordon | 137/636.2 X |
| 3,753,447 | 8/1973 | Davis et al. | 137/596 |
| 3,766,944 | 10/1973 | Distler | 137/625.6 |
| 4,184,512 | 1/1980 | Pignolet | 137/596 |
| 4,341,243 | 7/1982 | Melocik | 137/625.68 |
| 4,342,335 | 8/1982 | Reinicker et al. | 137/596 X |

FOREIGN PATENT DOCUMENTS

| | | | |
|---|---|---|---|
| 2639486 | 3/1978 | Fed. Rep. of Germany | 137/636.2 |
| 1494400 | 12/1977 | United Kingdom | 137/636.2 |

*Primary Examiner*—Gerald A. Michalsky
*Attorney, Agent, or Firm*—August E. Roehrig, Jr.

[57] ABSTRACT

A manually-operable hydraulic control device of the hydraulic pressure liquid directional control type, with hydraulic position-retention, particularly for regulating the flow of pressurized fluid supplied to the power jack of a component or implement of an earth moving machine, comprises a pair of valves and a control lever having a central neutral position and two respective extreme operative positions for controlling the said valves. The device is provided with hydraulic means for retaining the control lever in at least one of the said extreme operative positions.

8 Claims, 3 Drawing Figures

MANUALLY OPERABLE HYDRAULIC CONTROL DEVICE WITH HYDRAULIC POSITION RETENTION

The present invention relates to a manually-operable hydraulic control device with hydraulic position-retention, the device being usable in particular for hydraulic distributors of the hydraulic pressure liquid directional flow orienting type, intended for controlling the flow of pressurized fluid supplied to the power jack of a component or implement of an earth moving machine.

In particular, the invention relates to a manually-operable hydraulic control device with hydraulic position-retention, for hydraulic pressure liquid directional flow control valves, said device being of the type comprising:

a body having an inlet opening for connection to a source of pressurized fluid, two outlet openings for connection to two respective inlets of a hydraulic distributor, and a chamber communicating with a discharge tank, a pair of valves respectively arranged to progressively transmit the pressure present at the inlet opening to a corresponding one of the two outlet openings, the valve pair having two mutually-parallel slide valve members each of which has first and second ends and is displaceable in the direction of the first end into a first operative position in which the inlet opening is isolated and the corresponding outlet opening is connected to the said chamber, and in the direction of the second end into a second operative position in which the corresponding outlet opening is connected to the inlet opening, resilient means biasing each slide valve member towards a central position in which, as in the first operative position, the inlet opening is isolated and the corresponding outlet opening is connected to the said chamber, a control lever articulated to the body and having a central neutral position and two extreme operative positions in each of which this lever acts on the first end of a respective slide valve member to maintain the latter in its second operative position.

A device of the type mentioned above is described and illustrated in U.S. Pat. No. 3,766,944. Devices of this type have already been made which are provided with means for locking the control lever in at least one of the said extreme operative positions, so as to allow the operator to take his hand from the lever itself once this has been locked. The locking means used until now are of a mechanical type and thus have the disadvantage of making the structure of the device more complicated and bulky.

The object of the present invention is to provide a device of the type specified above which allows the retention of the control lever in at least one of its extreme operative positions and which, on the other hand, is structurally simple and of small bulk.

In order to achieve this object the invention provides a device of the type indicated above, the main characteristic of which lies in the fact that it includes means for transmitting the pressure present at the inlet opening to the second end of one of the said slide valve members when the other slide valve member is in its second operative position whereby to maintain the control lever in its corresponding extreme operative position by means of the slide valve member the second end of which is subject to the said pressure.

Owing to the said characteristic, it is possible to achieve automatic retention of the control lever in its extreme operative position by means of a relatively simple structure of small bulk. Furthermore, the use of retaining means of the hydraulic type allow the use of automatic control systems.

According to a further characteristic, the said means for transmitting the pressure present at the inlet opening to the second end of a slide valve member when the other slide valve member is in its second position, includes a duct formed in the body of the device and arranged to communicate at one end with the said inlet opening and at the other end with a chamber into which the second end of the said other slide valve member faces.

According to a further characteristic, an auxiliary valve is interposed in the said duct, and this latter also communicates by means of a passage of narrow cross section with the said chamber connected to the discharge tank.

In one preferred embodiment of the present invention, the said auxiliary valve consists of a solenoid valve.

In this case, the control lever is provided with a push button for controlling the solenoid valve.

Further characteristics and advantages of the present invention will emerge from the description which follows with reference to the appended drawings provided purely by way of non-limiting example, in which.

Figure 1:
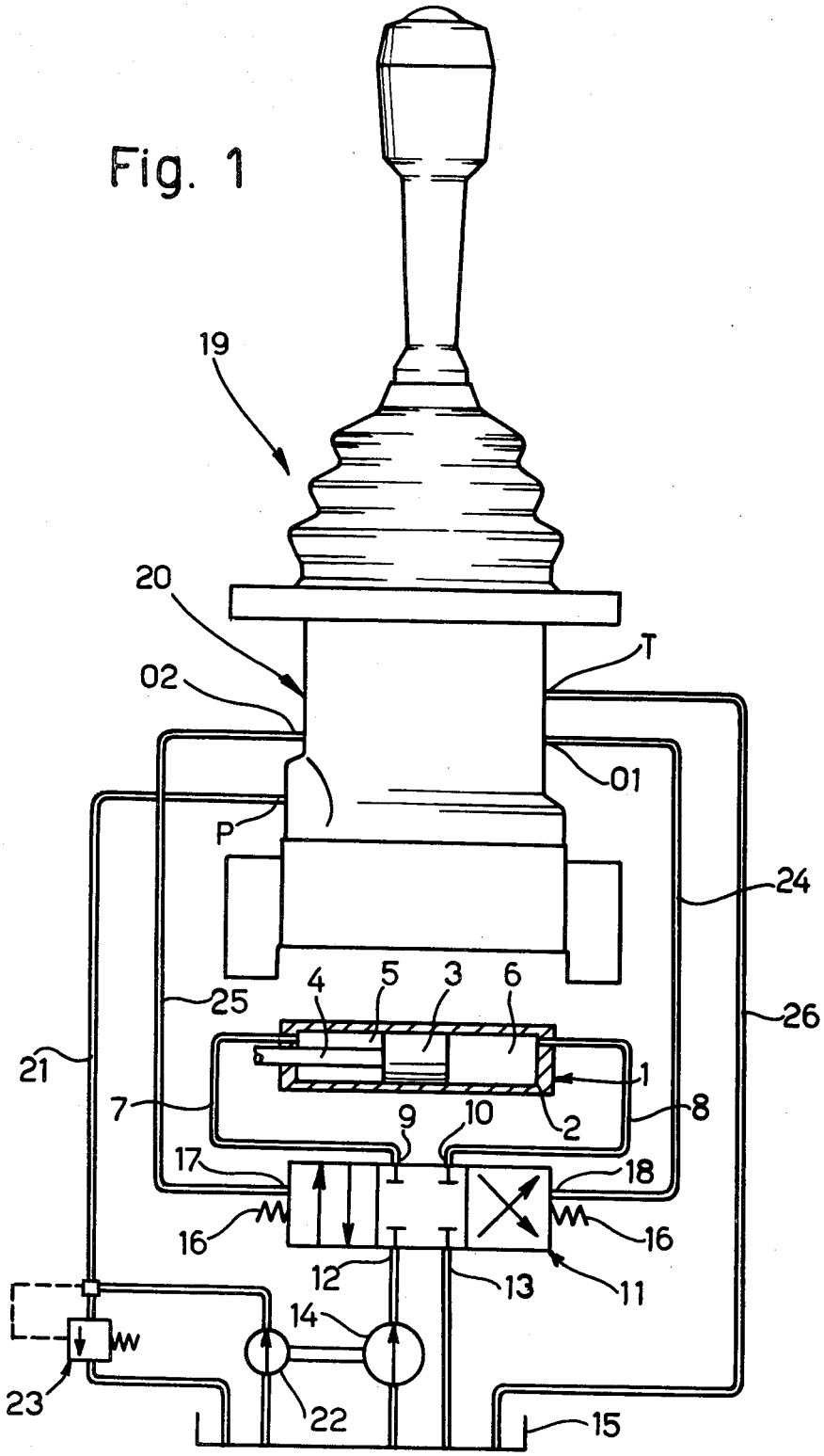
FIG. 1 is a schematic view of a hydraulic control system using a device according to the present invention.

In FIG. 1, by 1 is indicated a double-acting hydraulic cylinder for controlling, for example, the arms of an earth moving machine. The hydraulic cylinder 1 comprises a body 2 in which is slidably mounted a piston 3 provided with a drive shaft 4 extending out of the body 2. The piston 3 defines two chambers 5, 6 within the body 2.

The two chambers 5, 6 are connected by two ducts 7, 8 to two outlets 9, 10 of a hydraulic distributor 11. The distributor 11 is in the nature of a hydraulic pressure liquid directional control valve of the four way type, and has two inlets 12, 13 respectively connected to the delivery of a supply pump 14 and to a discharge tank 15.

The distributor 11 is conventionally provided with a movable member, such as a spool, having a neutral central position and two operative end positions. In the neutral central position, the inlets 12, 13 are isolated from the outlets 9, 10. In one of the two operative end positions, the inlets 12, 13 are connected respectively to the outlets 9, 10, while in the other operative end position, the two inlets 12, 13 are connected respectively to the outlets 10, 9.

The hydraulic distributor 11 is further provided with springs 16 acting on the ends of the movable member and, in conclusion, has two inlets 17, 18, communicating with two end chambers which face towards the ends of the movable member of the distributor. By supplying pressurized fluid to one of the two inlets 17, 18, the movable member of the distributor is displaced in the direction of the end chamber communicating with the other inlet, against the action of the corresponding spring 16.

In FIG. 1, the structure of the distributor 11 has been illustrated only schematically, since this structure is know per se in this branch of the art (see, for example, U.S. Pat. No. 3,766,944). Furthermore, the constructional details of the hydraulic distributor do not fall within the scope of the present invention. Finally, the elimination of these constructional details from the drawings makes the latter more immediately and easily understandable.

The supply of pressurized fluid to the two inlets 17, 18 of the hydraulic distributor 11 is controlled by a manually-operable hydraulic control device 19.

The device 19 includes a body 20 having an inlet opening P and two outlet openings 01 and 02. The inlet opening P is connected by a duct 21 to the delivery of an auxiliary supply pump 22 connected mechanically to the main pump 14. A relief type discharge valve 23 is connected to the duct 21 and arranged to discharge fluid supplied under pressure by the auxiliary pump 22 into the tank 15 when the inlet opening P is isolated, as will be explained in detail below. The two outlet openings 01 and 02 communicate respectively by means of ducts 24, 25 with the two inlets 17, 18 of the hydraulic distributor 11. The body 20 of the device has, finally, an outlet T connected by means of a duct 26 to the discharge tank 15.

Figure 2:
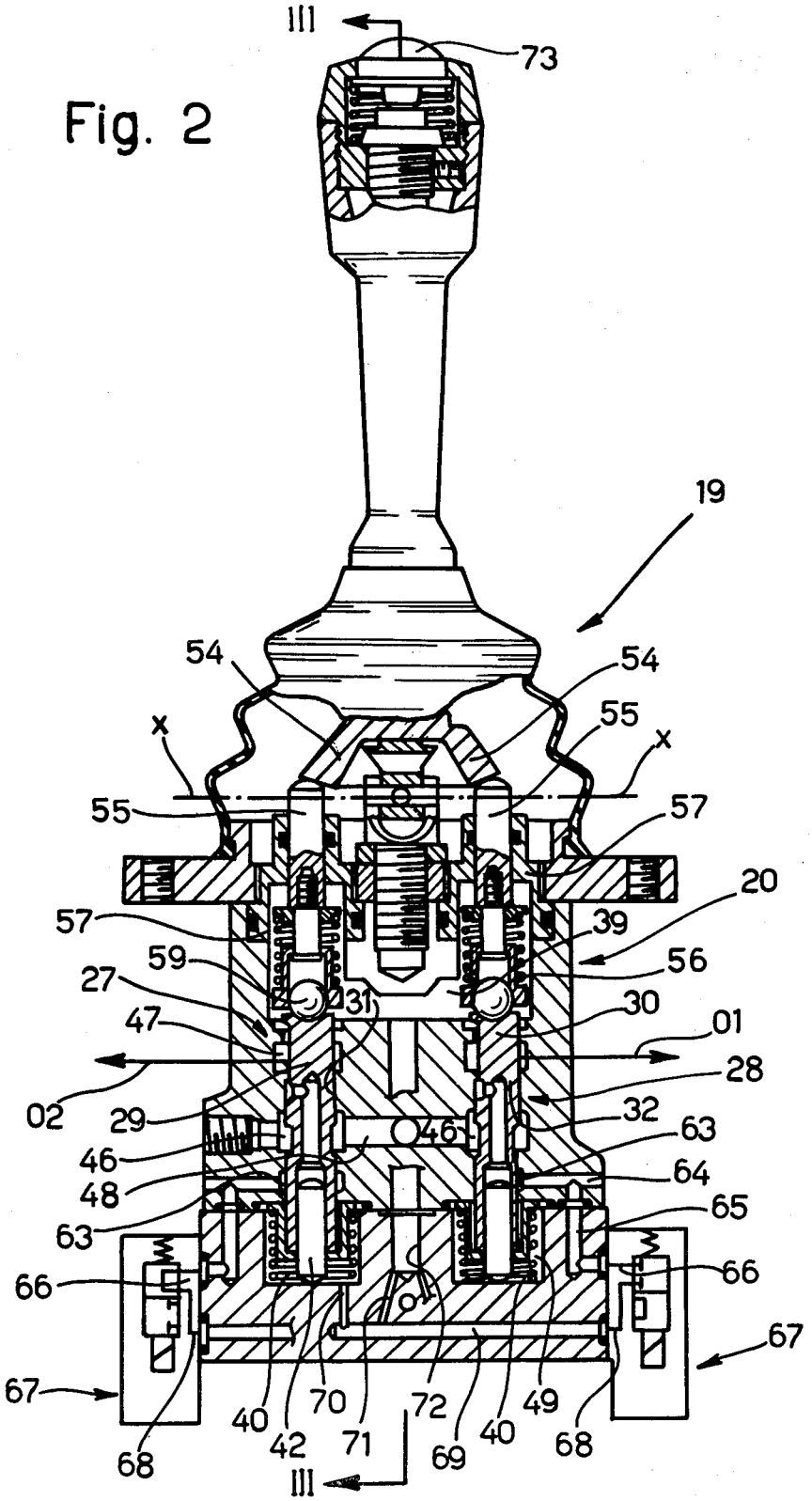
FIG. 2 illustrates in section an embodiment of the device according to the invention.

With reference to FIG. 2, the device 19 includes two slide valves 27, 28 for controlling the connection between the inlet opening P and the two outlet openings 01 and 02. The two valves 27, 28, include two slide valve members 29, 30 slidably mounted in two parallel, spaced apart, cylindrical cavities or bores 31, 32.

Figure 3:
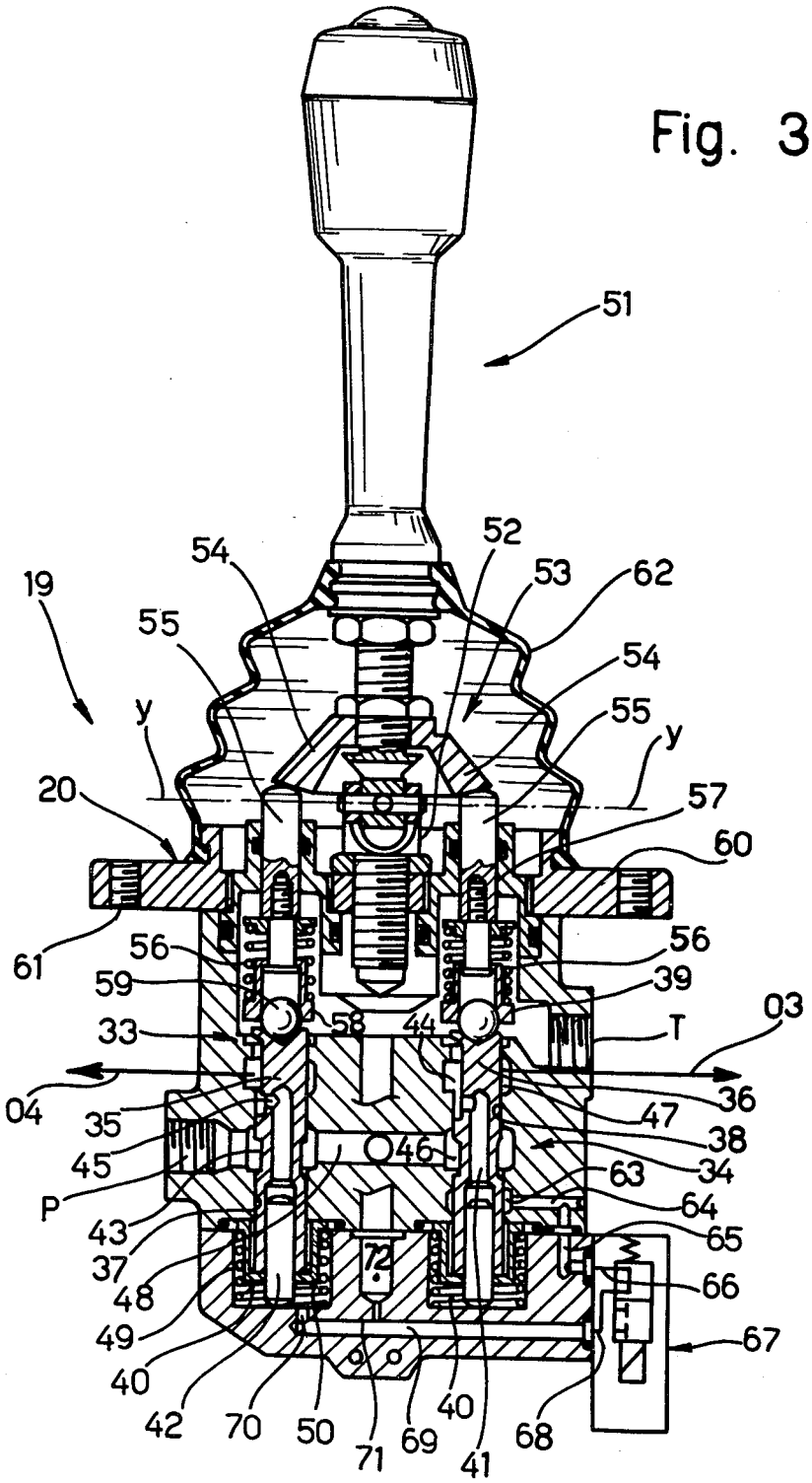
FIG. 3 is a sectional view taken on line III—III of FIG. 2.

As is seen in FIG. 3, the device 19 is further provided with a second pair of similar slide valves 33, 34 for controlling the connection between the inlet opening P and a second pair of outlet openings 03 and 04 connected to a second hydraulic distributor (not illustrated but of the same type as distributor 11) intended, for example, for controlling the jack drive of the bucket carried by the arms of the earth moving machine.

The two valves 33, 34 have two slide valve members 35, 36 slidably mounted in two parallel, spaced apart, cavities 37, 38. The axes of the two slide valve members 35, 36 lie in a plane perpendicular to the plane containing the axes of the slide valve members 29, 30.

The four valves 27, 28 and 33, 34 have identical structures.

The slide valve member of each of the said valves has a cylindrical body with a first end facing a chamber 39 which communicates, through the outlet T and the duct 26 with the tank 15, and a second end facing a chamber 40. Moreover, the body of each slide valve member has an axial cavity 41, extending from the said second end, in which is slidably mounted a guide pin 42 having an end projecting out of the cavity 41 and into contact with the bottom of the chamber 40.

The outer surface of each slide valve member has an annular groove 43 and an axial groove 44. A radial hole or port 45 opens at its ends respectively into the surface of the axial groove 44 and into the surface of the axial cavity 41.

The cavity in which each slide valve member is slidably mounted defines about this latter a first annular chamber 46 and a second annular chamber 47.

The annular chambers 46 communicate with each other through ducts 48. Furthermore, the annular chamber 46 associated with the valve 33 communicates with the inlet opening P. The annular chambers 47 associated with the four valves 27, 28 and 33, 34 communicate respectively with the four outlet openings 01, 02 and 03, 04.

In each chamber 40 is located a helical spring 49 which has one end in contact with the bottom of the chamber 40 and the opposite end in contact with the second end of the slide valve member with the interposition of a cup-shaped element 50.

The device 19 is provided with a control lever 51 articulated at its lower end to a support 52 forming part of the body 20, defining a universal joint about two axes X—X and Y—Y which are mutually perpendicular.

The control lever 51 is provided at its lower end with a force transmitting support 53 defining abutment means in the form of a disc 54 in contact with the outer ends of four shafts 55 slidably mounted in the body 20 of the device and each acting at its opposite inner end against the first end of a respective slide valve member 29, 30, 35, 36, with the interposition of a helical spring 56.

In the particular example illustrated, each shaft 55 is slidably mounted in a guide element 57 rigid with the body 20 of the device. Moreover, each helical spring 56 acts against the first end of the corresponding slide valve member with the interposition of a cup-shaped element 58 and a ball 59.

The body 20 is further provided with a flange 60 having apertures 61 for the insertion of screws for fixing the device to a support structure. A suitable flexible protective cover 62 is suitably secured to the control lever and to the flange 60.

With reference to FIG. 2, the two cavities 31, 32 in the body 20 of the device according to the present invention, each define an annular chamber 63 about the respective slide valve members 29, 30, each of which communicates through ducts 64, 65 with an inlet 66 of a solenoid type hydraulic pressure liquid off-on valve 67 of a suitable conventional type. This solenoid valve has an outlet 68 which communicates, through ducts 69, 70 formed in the body 20, with the chamber 40 associated with the opposite slide valve member. Each duct 69 communicates through a passage 71 of narrow cross-section with a duct 72 connected to the chamber 39. Ducts 64 are suitably sealed off at the external surface of body 20 (not shown).

As illustrated in FIG. 3, the cavity 38 in which the slide valve member 36 is slidably mounted also defines an annular chamber 63 communicating via ducts 64, 65 with the inlet 66 of a solenoid valve 67 the outlet 68 of which is connected through ducts 69, 70 with the chamber 40 associated with the slide valve member 35. The duct 69 illustrated in FIG. 3 is also connected via a passage 71 of narrow cross-section with the duct 72.

The operation of the device described above is as follows:

The control lever 51 can be rotated, or moved universal joint fashion, about each of the two articulation axes X—X and Y—Y. This lever 51 therefore has a central neutral position (illustrated in the drawings) and, for each rotational movement about one of the said two axes, two extreme operative positions. In each of these extreme operative positions, the control lever 51 displaces downwardly, with reference to the drawings, a corresponding slide valve member by means of the appendage 54, the shaft 55 and the spring 56.

When the control lever 51 is in its central neutral position, the four chambers 47 communicating with the outlet openings 01, 02 and 03, 04 also communicate through the grooves 44 with the chamber 39 connected to the discharge tank. Hence, in this condition, the two inlet openings 17, 18 of the hydraulic distributor 11 communicate, through the ducts 24, 25 the two outlet openings 01 and 02, the chambers 47, 39, the outlet opening T and the duct 26, with the discharge tank 15. The same applies to the other hydraulic distributor the inlet apertures of which are connected to the outlet apertures 03 and 04. In this condition, moreover, the chambers 43 communicating with the inlet opening P are isolated from tank 15, whereby the pressurized fluid supplied by the auxiliary pump 22 is discharged into the tank 15 by means of the relief valve 23.

Supposing, by way of example, the control lever 51 is rotated about the axis Y—Y so as to cause a downward displacement (with reference to FIG. 2) of the slide valve member 30 by means of the corresponding appendage 54, the shaft 55 and the helical spring 56 associated therewith. This downward displacement occurs against the action of the helical spring 49 associated with the valve 28. The stiffness of the spring 49 is less than that of the spring 56 whereby the downward displacement of the slide valve member occurs initially without deformation of the spring 56. After this displacement, the communication between the chamber 47 associated with the valve 28 and the chamber 39 is cut off while the groove 44 places the chamber 46 of the valve 28 in communication with the corresponding chamber 47. Thus, pressurized fluid can flow from the pump 22 to the inlet opening 18 of the distributor 11 through the duct 21, the inlet opening P, the passage 48, the chamber 46, the groove 44, the chamber 47, the outlet opening 01 and the duct 24. In this phase, pressurized fluid is also supplied through the radial hole 45 into the cavity 41 of the slide valve member 30.

Supposing now that the operator continues to displace the control lever, overcoming the increased opposing force of the spring 56 until the lever is brought into an extreme operative position in which the groove 43 places the chamber 46 in communication with the chamber 63. Supposing that the solenoid type off-on valve 67 is open for liquid flow therethrough, pressurized fluid can flow from the chamber 63 to the chamber 40 associated with the valve 27 through the ducts 64, 65, the solenoid valve 67, and the ducts 69, 70. The pressure present at the inlet opening P is thus transmitted to the lower end (with reference to FIG. 2) of the slide valve member 29 of the valve 27. The slide valve member 27 is thus thrust upwardly and, by means of the helical spring 56, the shaft 55 and the disc 54, hydraulically retains the control lever 51 locked in its extreme operative position.

In order to unlock the control lever, it suffices to move it manually towards its neutral central position overcoming the force exerted by the pressurized fluid supplied to the chamber 40, or to close the solenoid operated off-on valve 67 by means of a push button control 73 with which the upper end of the control lever 51 is provided. After this closure, in fact, the pressurized fluid in the chamber 40 is discharged through the ducts 71, 72 into the chamber 39 and from here through the outlet opening T into the tank 15. Control 73 and valve 67 are suitably incorporated in electrical circuitry that permits control button 73 to energize and deenergize valve 67 so as to shift same between closed and open positions, as is well known in the art. The nature of valve 67 is schematically illustrated in the drawings.

A similar operation occurs when the control lever 51 is moved into its extreme operative position corresponding to the activation of the valves 33 and 34.

Naturally, the principle of the invention remaining the same, the details of construction and the embodiments may be varied widely with respect to that described and illustrated purely by way of example, without thereby departing from the scope of the present invention.

I claim:

1. In a hydraulic liquid directional control valve including a hydraulic liquid directional flow orienting device including a directional central flow member movably mounted in same for movement from a central neutral position to operative flow orienting positions one on either side of the central position, a first conduit connected to said device for supplying hydraulic liquid under pressure to same to move said member to one of said positions, a second conduit connected to said device for supplying hydraulic liquid under pressure to same to move said member to the other of said positions, and a source of hydraulic liquid under pressure for said conduits, a hydraulic liquid directional control device for controlling the hydraulic liquid supplied to said conduits for selectively positioning said directional flow control member relative to said positions and comprising:

a housing body defining a chamber connected to tank and a pair of spaced parallel bores in side-by-side relation opening at like ends into said chamber, a slide valve member slidably mounted in each of said bores, with said slide valve members each having like ends of same adjacent said like ends of said bores respectively, one of said conduits being connected to one of said bores adjacent said like end thereof and the other of said conduits being connected to the other of said bores adjacent said like end thereof, said source of hydraulic liquid under pressure being connected to said bores adjacent the other ends thereof, said bores and slide valve members being formed to communicate said conduits through said bores to said chamber and isolate said hydraulic liquid source therefrom in like positions of said slide members within their respective bores to define the neutral position of said valve members, a control lever disposed intermediate said slide valve members and articulated to said housing body to shift from a neutral position to operative positions to either side of its said neutral position in a plane that includes said slide valve members, means for translating said shifting movement of said control lever to opposite and simultaneous movement of said slide valve members longitudinally of their respective bores, said slide valve members and said bores adjacent their other ends being formed to, when said control lever has been shifted to either of said operative positions to move one of said slide valve members inwardly of its bore from its neutral position to its corresponding operative position, communicate said source of hydraulic liquid under pressure to the other end of the other slide valve member thereby moving a portion of said other slide valve member outwardly of its bore into pressure contact with said control lever for hydraulically locking said control lever in the selective operative position, said slide valve members and said bores further being formed to when said slide valve members are in their said operative positions, communicate the hydraulic pressure liquid source connection that is adjacent the other end of the bore, of the slide valve member that is thereby disposed in its said operative position, to the conduit connection that is adjacent said like end of such bore, and means for releasing said hydraulic locking of said control lever.

2. The hydraulic directional control device set forth in claim 1 wherein:

said control lever in said neutral position thereof substantially parallels said slide valve members.

3. The hydraulic directional control device set forth in claim 1 wherein:

said translating means comprises an abutment structure carried by said control lever and pin means interposed between said abutment structure and the respective slide valve member like ends, and means for biasing said pin means against said abutment structure.

4. The hydraulic directional control device set forth in claim 1 wherein:

when said slide valve members are in their respective operative positions thereof, said hydraulic liquid source in being communicated to the other end of the other slide valve member effects actuation of same piston fashion.

5. The hydraulic directional control device set forth in claim 1 including:

a second set of said bores and said slide valve members arranged as claimed in claim 1 for similarly controlling a second similar hydraulic liquid directional flow orienting device and oriented in coplanar relation in a plane that is normal of the plane of the first set of bores, said second set of said bores and slide valve members being similarly controlled and actuated by said control lever and corresponding shaping of same.

6. The hydraulic directional control device set forth in claim 5 wherein:

the articulation of said control is of the universal joint type.

7. In a hydraulic liquid directional control valve including a hydraulic liquid directional flow orienting device including a directional central flow member movably mounted in same for movement from a central neutral position to operative flow orienting positions one on either side of the central position, a first conduit connected to said device for supplying hydraulic liquid under pressure to same to move said member to one of said positions, a second conduit connected to said device for supplying hydraulic liquid under pressure to same to move said member to the other of said positions, and a source of hydraulic liquid under pressure for said conduits, a hydraulic liquid directional control device for controlling the hydraulic liquid supplied to said conduits for selectively positioning said directional flow control member relative to said positions and comprising a housing body defining a chamber connected to tank and a pair of spaced parallel bores in side-by-side relation opening at like ends into said chamber, a slide valve member slidably mounted in each of said bores, with said slide valve members each having like ends of same adjacent said like ends of said bores respectively, one of said conduits being connected to one of said bores adjacent said like end thereof and the other of said conduits being connected to the other of said bores adjacent said like end thereof, said source of hydraulic liquid under pressure being connected to said bores adjacent the other ends thereof, said bores and slide valve members being formed to communicate said conduits through said bores to said chamber and isolate said hydraulic liquid source therefrom in like positions of said slide members within their respective bores to define the neutral position of said valve members, a control lever disposed intermediate said slide valve members and articulated to said housing body to shift from a neutral position to operative positions to either side of its said neutral position in a plane that includes said slide valve members, means for translating said shifting movement of said control lever to opposite and simultaneous movement of said slide valve members longitudinally of their respective bores, said slide valve members and said bores adjacent their other ends being formed to, when said control lever has been shifted to either of said operative positions to move one of said slide valve members inwardly of its bore from its neutral position to its corresponding operative position, communicate said source of hydraulic liquid under pressure to the other end of the other slide valve member for hydraulically locking said control lever in the selective operative position, said slide valve members and said bores further being formed to when said slide valve members are in their said operative positions, communicate the hydraulic pressure liquid source connection that is adjacent the other end of the bore, of the slide valve member that is thereby disposed in its said operative position, to the conduit connection that is adjacent said like end of such bore, and means for releasing said hydraulic locking of said control lever, said means for releasing said hydraulic locking of said control lever comprising a passage comprising part of said communication of said hydraulic pressure liquid source and communicating through a solenoid valve in off-on relation to said passage, and means for shifting said solenoid valve to close said passage.

8. The hydraulic directional control device set forth in claim 7 wherein:

said means for shifting said solenoid valve to close said passage comprises a push button control carried by said lever.

* * * * *